US010173880B2

(12) United States Patent
Niehr et al.

(10) Patent No.: US 10,173,880 B2
(45) Date of Patent: Jan. 8, 2019

(54) FILLING SYSTEM FOR FILLING BOTTLES OR SIMILAR CONTAINERS

(71) Applicant: KHS GmbH, Dortmund (DE)

(72) Inventors: Thomas Niehr, Bad Münster am Stein Ebernburg (DE); Jürgen Franz Vorwerk, Mörsdorf (DE)

(73) Assignee: KHS GmbH, Dortmund (DE)

( * ) Notice: Subject to any disclaimer, the term of this patent is extended or adjusted under 35 U.S.C. 154(b) by 20 days.

(21) Appl. No.: 15/324,837

(22) PCT Filed: Jun. 9, 2015

(86) PCT No.: PCT/EP2015/062775
§ 371 (c)(1),
(2) Date: Jan. 9, 2017

(87) PCT Pub. No.: WO2016/005122
PCT Pub. Date: Jan. 14, 2016

(65) Prior Publication Data

US 2017/0210608 A1 Jul. 27, 2017

(30) Foreign Application Priority Data

Jul. 9, 2014 (DE) ..... 10 2014 109 589

(51) Int. Cl.
*B67C 3/22* (2006.01)
*B67C 3/00* (2006.01)
(Continued)

(52) U.S. Cl.
CPC ..... *B67C 3/004* (2013.01); *B67C 3/06* (2013.01); *B67C 3/225* (2013.01); *B67C 3/242* (2013.01);
(Continued)

(58) Field of Classification Search
CPC ..... B67C 3/002; B67C 3/004; B67C 3/28; B67C 3/242; B67C 3/06; B67C 3/2614; B67C 3/225; B67C 3/24; B67C 2003/228
See application file for complete search history.

(56) References Cited

U.S. PATENT DOCUMENTS 3,604,480 A * 9/1971 Reichert ..... B67C 3/06 141/198
5,082,033 A * 1/1992 Weiss ..... B67C 3/06 141/198
(Continued)

FOREIGN PATENT DOCUMENTS

DE 93 19 866 2/1995
DE 103 40 365 3/2005
(Continued)

*Primary Examiner* — Nicolas A Arnett
(74) *Attorney, Agent, or Firm* — Occhiuti & Rohlicek LLP

(57) ABSTRACT

A filling system includes filling elements, each of which has a channel formed in its housing. During filling, filling material, under a liquid valve's control, passes through the channel and exits through an opening and into a container held on a vertically displaceable container carrier. During pressure filling, the container carrier seals the container against the filling element. During cleaning and sterilization, rinsing caps seal each opening. Each filling element is associated with an extension that seals the outlet. Each extension has a filling-material through-passage that, when the extension is sealed against said outlet, extends the filling-material channel.

19 Claims, 1 Drawing Sheet

(51) Int. Cl.

| | |
|---|---|
| ***B67C 3/26*** | (2006.01) |
| ***B67C 3/28*** | (2006.01) |
| ***B67C 3/06*** | (2006.01) |
| ***B67C 3/24*** | (2006.01) |

(52) U.S. Cl.
CPC ..... *B67C 3/2614* (2013.01); *B67C 3/28* (2013.01); *B67C 2003/228* (2013.01)

(56) References Cited

U.S. PATENT DOCUMENTS 5,226,463 A * 7/1993 Mette ..... B67C 3/2614 141/287
5,402,833 A * 4/1995 Clusserath ..... B67C 3/12 141/293
6,192,946 B1 * 2/2001 Clusserath ..... B67C 3/12 141/40
7,104,033 B2 * 9/2006 Krulitsch ..... B67C 3/004 141/91
7,513,279 B2 * 4/2009 Bernhard ..... B67C 3/004 141/147
8,776,842 B2 * 7/2014 Clusserath ..... B67C 3/004 141/89
8,833,407 B2 * 9/2014 Clusserath ..... B67C 3/286 141/115
8,931,526 B2 * 1/2015 Clusserath ..... B67C 3/2608 141/311 A
9,108,836 B2 * 8/2015 Clusserath ..... B67C 3/2622
9,205,937 B2 * 12/2015 Krulitsch ..... B67C 3/26
9,284,173 B2 * 3/2016 Krulitsch ..... B67C 3/004
9,340,402 B2 * 5/2016 Clusserath ..... B67C 3/004
9,511,986 B2 * 12/2016 Clusserath ..... B67C 3/26
9,522,818 B2 * 12/2016 Clusserath ..... B67C 3/02
9,790,072 B2 * 10/2017 Clusserath ..... B67C 3/001
2005/0086909 A1 * 4/2005 Krulitsch ..... B67C 3/004 53/167
2005/0172580 A1 * 8/2005 Krulitsch ..... B67C 3/004 53/471
2005/0198921 A1 * 9/2005 Clusserath ..... B67C 3/002 53/136.1
2007/0029002 A1 * 2/2007 Bernhard ..... B67C 3/004 141/144
2008/0072995 A1 3/2008 Jenne
2010/0108180 A1 * 5/2010 Clusserath ..... B67C 3/004 141/1
2012/0186695 A1 * 7/2012 Clusserath ..... B67C 3/2608 141/115
2014/0216604 A1 * 8/2014 Clusserath ..... B67C 3/004 141/277
2014/0366982 A1 * 12/2014 Clusserath ..... B67C 3/26 141/104
2015/0239722 A1 * 8/2015 Clusserath ..... B67C 3/02 141/90

FOREIGN PATENT DOCUMENTS

| | | |
|---|---|---|
| DE | 10 2008 029 208 | 12/2009 |
| DE | 10 2008 030291 | 12/2009 |
| DE | 10 2008 031680 | 1/2010 |
| DE | 10 2010 051450 | 5/2012 |
| DE | 10 2012 111 748 | 6/2014 |
| EP | 0 499 776 | 8/1992 |
| EP | 1 512 663 | 3/2005 |

* cited by examiner

FILLING SYSTEM FOR FILLING BOTTLES OR SIMILAR CONTAINERS

RELATED APPLICATIONS

This application is the U.S. national stage under 35 USC 371 of international application PCT/EP2015/062775, filed on Jun. 9, 2015, which claims the benefit of the Jul. 9, 2014 priority date of German application DE 102014109589.8, the contents of which are herein incorporated by reference.

FIELD OF INVENTION

The invention relates to container processing, and in particular, to filling containers.

BACKGROUND

Certain known filling elements fill containers with liquid filling-material under pressure. This procedure is often called "pressure filling."

In pressure filling, the container is pressed with its container mouth against a sealing element provided at the filling element such that the latter is located in a sealed position on the container. The filling of the container then takes place with the seal being maintained.

There are also times when it becomes necessary to clean a filling element. One way to do this is called the "clean-in-place " or "CIP" method. This method involves arranging rinsing caps, or CIP caps, in sealed positions beneath each of the filling elements' outlets. Each rinsing cap thus blocks flow out of the outlet that it seals and therefore permits the cleaning of the filling element associated with that outlet. For sterilizing the filling elements, it is known to use hot water or steam.

A disadvantage of filling systems with CIP caps, in particular those configured for steam sterilization, is that, due to their substantial structural height, it becomes necessary to raise or lower containers over a relatively long lifting distance.

SUMMARY

An object of the invention is to provide a filling system that is optimally configured to reduce the lifting path of the container that is to be filled.

The invention relates to a filling system for the filling of containers. The filling system comprises a multiplicity of filling elements, which, for example, are held on a running rotor, in particular a rotor that is driven continuously or intermittently.

Each filling elements includes a filling-element housing having a filling-material channel. The filling-material channel has an inlet for receiving the filling material from a filling-material tank. It also has a filling-material outlet through which, during filling, the liquid filling-material emerges from the filling-element housing. The filling takes place in a controlled manner through a liquid valve such that filling material flows in a defined quantity into a container that is with its container mouth under the filling-material outlet.

The filling system further assigns, to each filling element, a vertically-displaceable container carrier for holding the container and, in the case of pressure filling, for sealing the container against the filling element. The sealing of the container is an indirect sealing because an intermediate element, such as a seal, establishes the fluid-tight connection. As used herein, a seal that relies on an intermediary element will be referred to as an "indirect seal."

The filling system also assigns, to each filling element, a rinsing cap, which is sometimes referred to as a "CIP" cap. During rinsing and/or sterilization of the filling element, this rinsing cap can be pressed against the filling-material outlet. The rinsing caps are arranged on or are integral elements of a carrier ring. Because the carrier ring, in contrast with individual rinsing caps, cannot be pivoted away, containers that are to be raised would have to be conveyed through apertures in the carrier ring. This is an elaborate procedure that is prone to faults. To overcome this disadvantage, the filling system has a carrier ring that is configured to form a part of the filling valve, and in particular, to act as a lower valve section or valve channel such that the carrier ring, or the carrier, forms a combined CIP and filling channel ring.

Accordingly, the filling system assigns, to each filling element, an extension that can be arranged in a sealing position on the filing element's filling-material outlet. This extension has a filling-material through-passage that, when the extension is arranged on the filling-material outlet, extends the filling element's filling-material channel. As a result, despite having rinsing caps that can be placed under the filling material outlets for CIP cleaning or sterilization, it is only necessary to raise the container by a short distance to bring it into the filling position against the filling element.

According to one exemplary embodiment, the extension comprises, at the end of a filling-material through-passage through the extension and that faces away from the filling element, a sealing element or a sealing section against which a container can be sealed in a sealing position at the extension. As a result, the extension forms a fluid-tight extension of the filling material channel of the filling element against which the container can be pressed in the sealing position such that pressure-filling containers can be achieved with a reduced lifting movement of the containers.

In some embodiments, the filling-material through-passage is a conical passage that has its narrow end configured such as to run conically to the end facing away from the filling element. Accordingly, the extension forms an element that tapers the cross-section of the filling material through-passage along the filling material path. In free-jet filling, this optimizes filling-material conveyance. As a result, the filling system is a combined filling system that can be used both for pressure filling as well as for free-jet filling.

The passage is, of course, not truly conical because a cone ends in a single point. This cannot be the case in a practical filling element. Accordingly, as used herein, "conical," as well as cognates thereof, refers to "frustoconical."

In some embodiments, the sealing element or the sealing section forms a conically running filling material through-passage. Accordingly, the sealing element or the sealing section fulfills a dual function: during pressure filling, it allows an arrangement of the container in a sealing position against the extension, and during free-jet filling, it also optimizes filling-material flow.

Some embodiments feature a disk-shaped or annular carrier ring that retains the extensions and the rinsing caps. This carrier ring is rotatable relative to the filling elements. It also has accommodation mounts for the extensions and the rinsing caps.

A small rotational movement of the carrier ring into a first rotational position thus seals all the filling-material openings with rinsing caps at once. Another small rotational movement of the carrier ring into a second rotational position is enough to seal an extension against each filling element for pressure filling through the extensions.

In some embodiments, the extensions and the rinsing caps alternate with each other along the carrier ring. In others, there is a gap between them.

In some embodiments, another rotation brings the carrier ring into a position in which neither a rinsing cap nor an extension is aligned underneath the filling element. The filling element can then be used for pressure filling.

In other embodiments, the rinsing caps and the extensions comprise, on upper sides thereof, sealing elements or sealing sections that face the filling elements. These are arranged in a common plane. As a result, the rinsing caps or extensions can be arranged to be fluid-tight in relation to the respective filling element housing simply by rotating the carrier ring. In such embodiments, it is not necessary to raise either a rinsing cap or an extension to attain a fluid-tight arrangement at the filling element housing. This considerably simplifies the filling system's structure.

In one exemplary embodiment, the rinsing caps and the extensions are the same height or essentially the same height. As a result, the extensions essentially fill in the space that would normally be required for an arrangement of the rinsing caps underneath the filling element or filling-material outlet. This shortens the lifting path by the height of the extension. The extensions thus compensate for the free space incurred by the rinsing caps underneath the filling elements.

In some embodiments, the rinsing caps are configured for use with steam sterilization. This results in certain structural distinctions and is not a mere intended use. In particular, condensation occurs during steam sterilization. As a result, additional structure is required to accommodate and process condensate. In such embodiments, the filling caps include catchment areas. These are configured in the form of a bowl or cup. The catchment areas are configured to accommodate condensate that forms during steam sterilization. This allows the condensate to escape downwards via the filling-material outlet. As a result, the condensate avoids impeding the sterilization process, in particular, in the region of the filling-material outlet.

In some embodiments, the rinsing caps have a cap height of at least twenty millimeters, and preferably at least thirty millimeters. Rinsing caps with such a cap height are particularly well-suited for use with a steam sterilization system in part because they ensure an adequate drainage capacity for the condensate.

In some embodiments, a ring line provides a fluid connection between the rinsing caps. This ring line drains condensate that condenses during steam sterilization. As a result, the condensate dripping from the filling element passes via the rising caps and the ring line to an opening provided therein to be drained off via that opening.

As used herein, "pressure filling" is understood to mean in general a filling method in which the container to be filled is in contact in the sealing position against the filling element, and, as a rule, before the actual filling phase, i.e. before the opening of the liquid valve, is pre-tensioned with a pressurized tensioning gas, such as an inert gas or CO2 gas, by way of at least one controlled gas path formed in the filling element, this gas, during the filling of the filling material flowing to the container, then being increasing forced out of the interior of the container as return gas, and likewise via at least one controlled gas path formed in the filling element. This pre-tensioning phase can be preceded by other treatment phases, such as evacuation and/or rinsing or flushing of the container interior with an inert gas, such as CO2 gas etc., and specifically likewise via the gas paths formed in the filling element.

As used herein, "free-jet filling" refers to a filling method in which the liquid filling material flows to the container that is to be filled along a vertical or essentially vertical flow path in a free-flowing jet, and in which the container is not in contact with its container mouth or opening at the filling element but is instead at a distance from the filling element or from a filling material outlet located at the filling element. A further feature of this method is that air which is forced out of the container during the filling process by the liquid filling material does not pass into the filling element or into a region or channel formed there, which conveys gas, but instead flows freely into the surrounding environment.

As used herein, "container" refers to cans, bottles, tubes, pouches, in each case made of metal, glass, and/or plastic, but also other packing means that are suitable for filling with fluid or viscous products.

As used herein, expressions such as "essentially" or "approximately" signify deviations from an exact value in each case by±10%, preferably by±5%, and/or deviations that are not significant function.

Further embodiments, advantages, and possible applications of the invention are also derived from the following description of exemplary embodiments and from the figures. In this context, all the features described and/or graphically represented are in principle the object of the invention, alone or in any desired combination, regardless of their connection in the claims or reference to them. The contents of the claims are also made a constituent part of the description.

BRIEF DESCRIPTION OF THE FIGURES

The invention is described in greater detail hereinafter on the basis of figures in relation to exemplary embodiments. The figures show.

DETAILED DESCRIPTION

Figure 1:
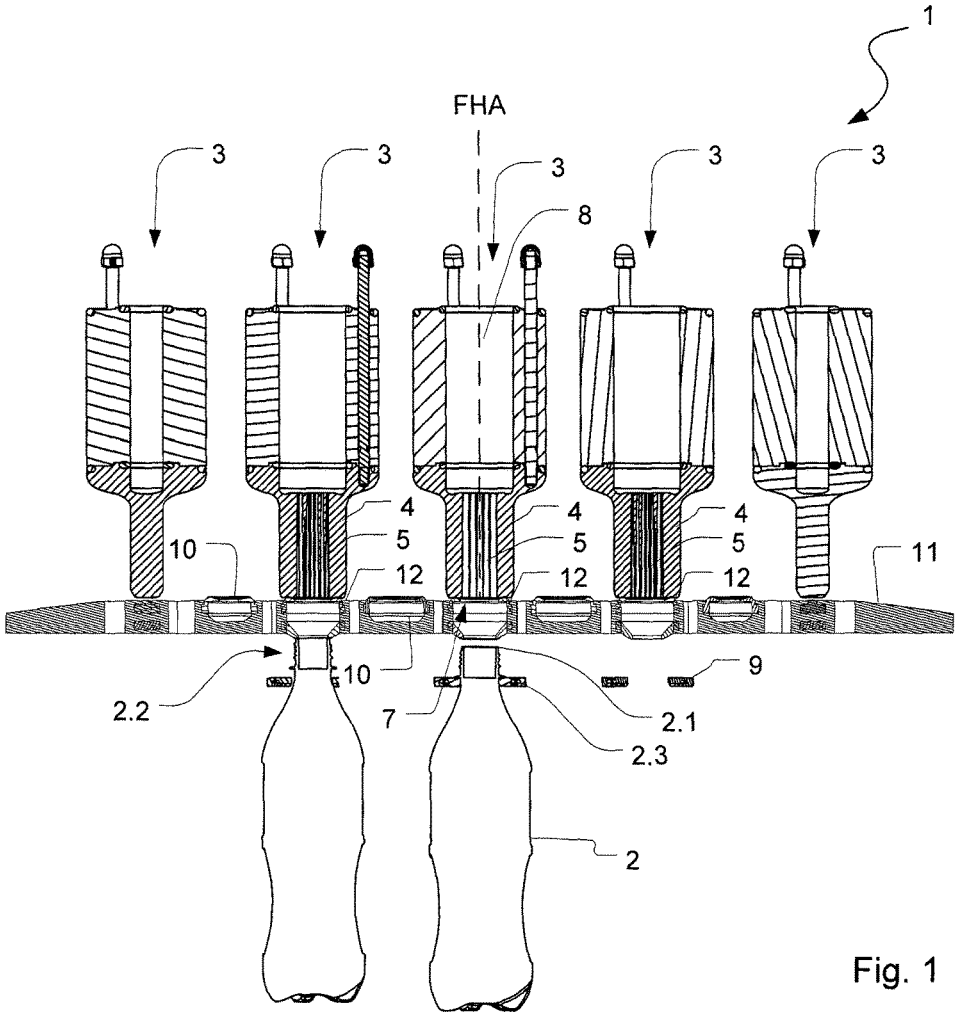
FIG. 1 shows a filling system.

FIG. 1 shows a filling system 1 that directs a filling-material jet along a vertical flow path and into a container opening 2.1 of a container 2 during a filling process.

In some embodiments, the filling system 1 is a combined filling system that carries out both free-jet filling and pressure filling. In free-jet filling, the filling-contents flow in a free jet into a container 2 that is at some distance from the filling element 3. In pressure filling, the container 2 is seals against the filling element 3.

The filling system 1 has many identical filling elements 3 arranged along the circumference of a rotor that rotates about a vertical machine axis FHA. Each filling element 3 has a filling-element housing 4 in which is formed a filling-material channel 5. An upper region of the filling-material channel 5 connects, via a product line, to a tank. The tank, which need not be shown, is common to all the filling elements 3 of the filling system 1 and provides the liquid filling-material to all the filing elements. In the lower region of the filling-element housing 4, the filling-material channel 5 forms a filling-material outlet 7 through which the filling material emerges from the filling-element housing 4. A liquid valve 8 upstream of the filling-material outlet 7 and within the channel 5 controls the flow of filling material into the container 2.

Each filling element 1 has an associated container carrier 9 that suspends a container 2 to be filled. It does so using a neck-ring gripper that engages around the container 2 in a region if its neck 2.2, beneath a flange or neck ring 2.3 formed there. The container carrier 9 moves vertically up and down. In particular, the container carrier 9 raises the container 2 from a transfer position into a filling position. In some embodiments, the container stands on a carrier panel or plate. The carrier panel or plate can be vertically displaced such that one or more containers can be raised and lowered.

The filling system 1 is configured to be cleaned and sterilized using a clean-in-place ("CIP") process. To facilitate this type of cleaning, each filling element 3 has an assigned rinsing cap 10. The rinsing cap 10 can be moved under the outlet 7 and can be connected so that it seals against the filling-element housing 4 in the region of the filling-material outlet 7. This rinsing cap 10 thus seals the filling-element housing 4 in the region of the filling-material outlet 7.

The rinsing cap 10 is configured for use in a hot-steam sterilization process. Unlike hot-water sterilization, steam sterilization results in condensate that drips into the rinsing cap 10. A ring channel connected to all the rinsing caps 10 drains this condensate away. However, this condensate tends to form a temperature barrier. It is thus important for the rinsing cap to be sufficiently deep. Otherwise, sterilization may be inadequate.

To avoid inadequate sterilization, the rinsing caps 10 have a height h that is at least 20 millimeters, and preferably 30 millimeters, 35 millimeters, or even 40 millimeters. Rinsing caps 10 shallower than about 20 millimeters are likely to result in inadequate sterilization, particularly in the region of the filling-contents outlet 7.

An annular or disk-shaped carrier 11, which can also be called a "carrier ring," and which is hereafter referred to as "annular carrier" for brevity, runs under the filling elements 3. The annular carrier 11, which retains the rinsing caps 10, rotates relative to the filling elements 3. As a result, it is possible for the annular carrier 11 to move the rinsing caps 10 between an active position, in which the rinsing caps 10 seal their corresponding filling-material outlets 7, and an inactive position, in which the rinsing caps 10 move away from and open their respective filling-material outlets 7.

Each rinsing cap 10 has an upper side that faces its associated filling element. The upper side has a sealing section 10.1 that seals against the filling-material outlet 7. The rotational movement of the annular carrier 11 is thus enough to provide a fluid-tight closure of the filling-material outlet 7. There is no need to raise the rinsing cap 10 parallel to the filling element's vertical axis FHA to attain fluid-tight closure.

In order to be able to be able to use the filling system 1 both for free-jet filling, for example of still beverages (i.e. beverages free of carbonic acid or low in carbonic acid), as well as for pressure filling, and when pressure filling, to avoid having to raise containers 2 a long distance from the transfer position into the filling position, at least one extension 12 is assigned to each filling element 3. These extensions 12 are preferably likewise retained by the annular carrier 11 or are constituent parts of the annular carrier 11. As such, rotating the annular carrier 11 moves all the extensions 12 at the same time between an active position and an inactive position.

When in the active position, the extension 12 is directly beneath the outlet 7. In the inactive position, the extension 12 lies laterally next to the filling material outlet 7 and offset from the filling element 3.

Figure 2:
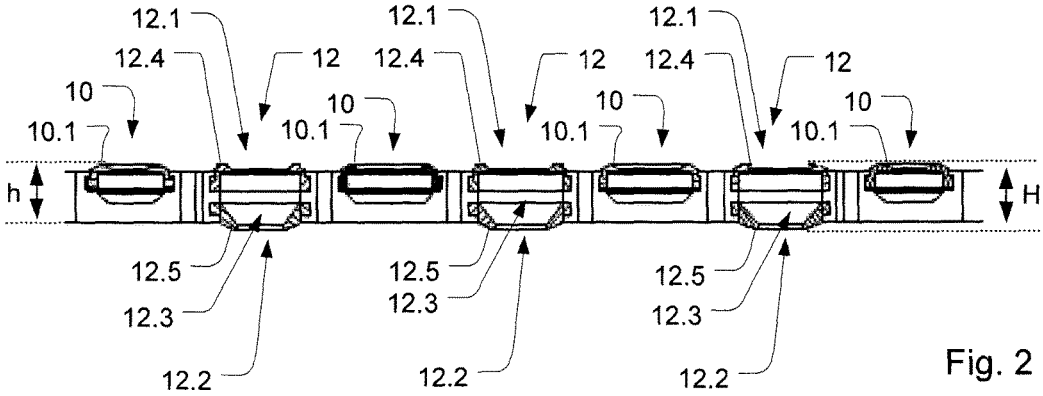
FIG. 2 shows details of a carrier used in the filling system of FIG. 1.

As shown in FIG. 2, rinsing caps 10 alternate with and are offset from the extensions 12 on the annular carrier 11. Because of this arrangement, when the annular carrier 11 rotates, either a rinsing cap 10 or an extension 12 will be placed under the filling material outlet 7.

An extension 12 is an essentially annular structure having a circular cross-section and extending from an extension upper-side 12.1 to an extension underside 12.2. A filling-material through-passage 12.3 extends through the extension 12 from its extension upper-side 12.1 to its extension underside 12.2.

A first seal 12.4 disposed at the extension upper-side 12.1 creates a fluid-tight connection between the filling-material channel 5 and the filling-material through-passage 12.3. Similarly, a second seal 12.5 disposed at the extension underside 12.2 creates a fluid-tight connection between the filling-material through passage 12.3 and the interior of the container 2.

When the annular carrier 11 rotates to place the extension 12 under the filling-material outlet 7, the seal 12.4 makes a fluid-tight connection without anything having to be raised in the direction of the filling element's vertical axis FHA. The extension 12 therefore has the effect of displacing the filling-material outlet 7 of the filling element 3 downwards by the height of the extension 12. This means that, during pressure filling, it is possible to significantly shorten the distance with which the container 2 must be raised.

In some embodiments, the filling material through-passage 12.3 defines a frustoconical structure having a cone axis coincident with the vertical axis FHA and having its base facing the first sealing section 12.4. This can be achieved by having the second seal 12.5 makes the cross-section of the filling material through-passage 12.3 smaller as one proceeds along the filling material's flow direction. As an alternative, the extension 12 can itself be formed as running conically in the wall region. In either case, a conical through-passage 12.3 improves filling, and in particular, free-jet filling.

The height H of the extension 12 is preferably adapted to the height h of the rinsing cap 10. In particular, the height H of the extension 12 can correspond to, or at least essentially correspond to, the height h of the rinsing cap 10. Preferably, the height H of the extension 12 is at least 20 millimeters, preferably 30 millimeters, 35 millimeters, or 40 millimeters. As a result, despite the relatively substantial height h of the rinsing caps 10, the containers 2 only need to be undergo a small lifting displacement, for example a lifting displacement of between 5 millimeters and 15 millimeters, in particular 6 millimeters, 8 millimeters, or 10 millimeters, in order to reach the sealing position at the extension 12.

A particular advantage of the annular carrier 11, which is configured as a combined CIP ring and filling channel ring, is that it becomes possible to dispense with individual drives and controls for individual rinsing caps at each filling point or filling valve. This means that a great many moving components can be avoided. For example, in comparable filling machines, and outflow was required for each of the fifty to one-hundred individual pivotable rinsing caps.

A process improvement arises because the apparatus as described herein greatly reduces the number of the parts and channels that need to be cleaned. For example, only one fluid drain servers all the rinsing caps 10.

In addition, the overall apparatus can be made smaller. This is in part because the vertical movement of the containers need only be a few millimeters in order, on the one hand, to bring the container mouths into the sealing position at the valve outlet, and, on the other, to release the carrier ring 11 again for its movement in the circumferential direction.

Yet another advantage is that the carrier ring 11 requires only one single drive or a coupling element, thus reducing the space required for the apparatus. Additionally, this can be arranged in the dead angle of the rotation machine, i.e. in the angle range in which no container treatment takes place.

The invention has been described heretofore by way of exemplary embodiments. It is understood that a large number of variations or derivations are possible, without thereby departing from the inventive concepts on which the invention is based.

The invention claimed is:

1. An apparatus for filling containers, said apparatus comprising a plurality of vertically-displaceable container-carriers, a plurality of filling elements, each of which is associated with one of said vertically-displaceable container-carriers such that, during pressure filling, said container-carrier seals a container against a filling element associated therewith, each of said filling elements comprising a housing through which is formed a filling-material channel, an outlet through which filling material exits into a container, and a liquid valve that controls flow of filling material through said outlet, said apparatus further comprising a plurality of rinsing caps, each of which is configured to be sealed against an outlet of a corresponding one of said filling elements during cleaning and sterilization of said filling element, a plurality of extensions, wherein each of said extensions is configured to be sealed against an outlet of a corresponding one of said filling elements, wherein each of said extensions is configured to extend said filling-material channel of said corresponding one of said filling elements, and a carrier element that is disposed above said plurality of container-carriers, wherein said carrier element either retains or is integral with said extensions and said rinsing caps, and wherein said carrier element rotates relative to said filling elements.

2. The apparatus of claim 1, wherein said extension comprises a seal, a first end, and a second end, wherein said first end and said second end are disposed at opposite ends of said filling-material through-passage, wherein said second end faces away from said filling element, wherein said seal is disposed at said second end, and wherein, during pressure filling, said container is sealed against said seal at said second end of said extension.

3. The apparatus of claim 2, wherein said seal forms a conical through-passage.

4. The apparatus of claim 1, wherein said extension comprises a first end and a second end, wherein said first end and said second end are disposed at opposite ends of said filling-material through-passage, and wherein said filling-material through-passage is a conical passage that is narrower at said second end then at said first end.

5. The apparatus of claim 1, wherein said rinsing caps and said extensions have the same height.

6. The apparatus of claim 1, wherein said rinsing caps are configured for use with steam sterilization of said filling elements.

7. The apparatus of claim 1, wherein said rinsing caps are each at least twenty millimeters tall.

8. The apparatus of claim 1, wherein said rinsing caps are each at least thirty millimeters tall.

9. The apparatus of claim 1, wherein each of said extensions is at least twenty millimeters long.

10. The apparatus of claim 1, wherein each of said extensions is at least thirty millimeters long.

11. The apparatus of claim 1, further comprising a ring line that connects all rinsing caps to each other, wherein said ring line is configured to drain condensate that is formed during steam sterilization.

12. The apparatus of claim 1, wherein said rinsing caps alternate with said extensions such that each extension is between a pair of rinsing caps and each rinsing cap is between a pair of extensions.

13. The apparatus of claim 1, wherein each rinsing cap has a depth that is selected such that a temperature barrier formed from condensate during sterilization with steam is far enough away from said opening such that said opening can be sterilized.

14. The apparatus of claim 1, wherein said carrier element, as a result of rotation thereof, seals an opening in which one of said filling elements with a corresponding one of said rinsing caps.

15. The apparatus of claim 1, wherein said carrier element is configured such that rotational movement of said carrier element is sufficient to case a fluid-tight closure of each one of said outlets by a corresponding one of said rinsing caps.

16. The apparatus of claim 1, wherein each of said filling-material channels has a variable length.

17. The apparatus of claim 1, wherein each of said filling-material channels has a first length and a second length, wherein said second length exceeds said first length by an extent of a corresponding one of said extensions.

18. The apparatus of claim 1, wherein each of said filling elements is configured to carry out pressure filling of a container that is separated from said outlet.

19. The apparatus of claim 1, wherein said container is separated from said outlet by an amount equal to a height of said rinsing cap.

* * * * *